US005291769A

United States Patent [19]

Miyano

[11] Patent Number: 5,291,769

[45] Date of Patent: Mar. 8, 1994

[54] APPARATUS FOR FORMING END PORTION OF PIPE

[75] Inventor: Toshiharu Miyano, Barrington Hills, Ill.

[73] Assignee: Kabushiki Kaisha Milano, Mitaka, Japan

[21] Appl. No.: 882,320

[22] Filed: May 13, 1992

[30] Foreign Application Priority Data

May 16, 1991 [JP] Japan ..... 3-141080

[51] Int. Cl.[5] ..... B21D 41/04

[52] U.S. Cl. ..... 72/121

[58] Field of Search ..... 72/121, 110, 107, 104

[56] References Cited

U.S. PATENT DOCUMENTS 3,260,089 7/1966 Hazelton et al. ..... 72/121
3,851,515 12/1974 Hautau ..... 72/121
4,143,535 3/1979 Bouman ..... 72/121
4,771,625 9/1988 Watanabe et al. .

*Primary Examiner*—Lowell A. Larson
*Attorney, Agent, or Firm*—Ladas & Parry

[57] ABSTRACT

A plurality of profile rolls which are revolving are radially inwardly pressed against the peripheral surface of an end portion of a pipe to be formed so that a suitable profile is plastically formed on the end portion of the pipe. Each of the profile rolls is rotatably carried by a shaft at the distal end of a swing assembly whose proximal end is pivotably mounted to a pivot shaft on a rotary assembly which is rotatable. A cam follower on the distal end shaft of each swing assembly is forced by a cam laterally so that the rotary assemblies are rotated, resulting in radially inward displacement of the profile roll. Thus, the apparatus is compact in size, easily operable at a working site and reliable in operation.

12 Claims, 5 Drawing Sheets

APPARATUS FOR FORMING END PORTION OF PIPE

BACKGROUND OF THE INVENTION

The present invention relates to an apparatus for forming an end portion of a pipe and, more particularly, to an apparatus for carrying out, at a working site, plastic formation of an end portion of a refrigerant pipe of a refrigerating machine in a simple manner and in such a way that the end portion of the pipe will assume a predetermined profile suitable for connecting two pipe ends through a pipe coupling.

It has been known that plastic formation is carried out at one or both ends of a refrigerant pipe at a working site so that one or both ends of the pipe have a suitably profiled sectional shape in order to facilitate the connection of two pipes through a pipe coupling by merely inserting the formed ends of the pipes into the pipe coupling with a single action. A known pipe-end forming apparatus generally comprises a pipe holding device for rotatably holding a pipe to be formed, a plurality of profile rolls arranged around the peripheral surface of the tip end portion of the pipe held by the pipe holding device so as to press against the pipe end portion during the rotation thereof, and hydraulic cylinders for thrusting the profile rolls radially inwardly against the pipe.

In the known apparatus of the type described above, the profile rolls are radially inwardly pressed by the hydraulic cylinders against the outer peripheral surface of the end portion of the pipe which is caused to rotate whereby a profile complementary to the profile of the profile rolls is formed on the pipe end portion by plastic deformation.

In the case of the known apparatus of the type described above, the forces produced by the hydraulic cylinders are exerted radially to urge the profile rolls to press against the end portion of a pipe, and therefore the hydraulic cylinders must be extended radially outwardly. As a result, the forming apparatus must necessarily be large in bulk. Furthermore, since a pipe to be formed normally having a relatively large length must be rotated so that the pipe holding device is necessarily complex in construction and large in size. Such forming apparatus large in size is very inconvenient for transportation to a working site at which pipes are processed.

SUMMARY OF THE INVENTION

The present invention has been made to solve the above and other problems encountered in the known apparatus for forming a pipe end portion and has for its object to provide an apparatus for forming an end portion of a pipe, which is compact in size so that the transportation of the apparatus is facilitated and which is simple to operate because it is not needed to rotate the pipe to be formed.

In order to attain the above described object, the apparatus for forming an end portion of a pipe comprises: pipe holding means for securely holding an end portion of a pipe to be formed; rotary means provided adjacent to said pipe holding means so as to be rotatable coaxially with the end portion of the pipe held by the pipe holding means; drive means for rotating the rotary means; a plurality of shafts securely held by the rotary means so as to extend parallel with the pipe held by the pipe holding means; a plurality of swing means having proximal ends pivoted to said shafts, respectively, and having distal ends directed radially inward so as to be in opposing relationship with the end portion of the pipe to be formed; a plurality of profile rolls carried by the distal ends of the swing means, respectively; biasing means for imparting forces to the swing means so that the swing means will be caused to rotate in such directions that the profile rolls are moved away from the end portion of the pipe; and lateral force application means supported by the rotary means adjacent to a lateral side of each swing means for imparting a force to each swing means in a lateral direction across the swing means against the force of the biasing means.

When a pipe to be formed is clamped by the pipe holding means and then drive means is energized to rotate the rotary means and to energize the lateral force application means, the swing means which are supported by the shafts, respectively, revolve around the end portion of the pipe and swing slowly by the action of lateral force application means. Each of the profile rolls which are supported by the shafts at the distal ends, respectively, of the swing means gradually approaches the pipe to press against the outer peripheral surface thereof so that a profile complementary to that of the profile rolls is plastically formed around the surface of the end portion of the pipe. After the above described forming process has been completed, the lateral force application means are deenergized and the profile rolls and the swing means which hold the profile rolls, respectively, move away from the formed pipe under the force of the biasing means.

DESCRIPTION OF THE PREFERRED EMBODIMENT

Referring to the accompanying drawings, an embodiment of the present invention will be described.

Figure 1:
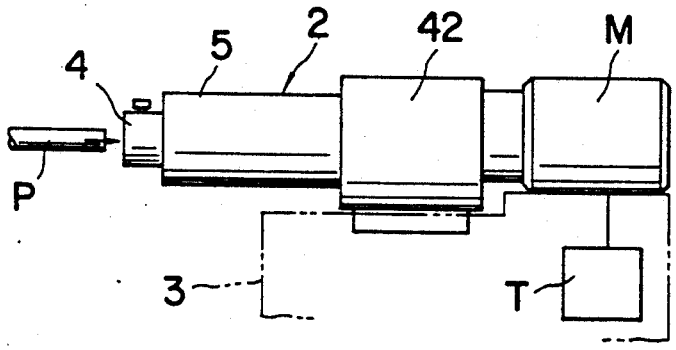
FIG. 1 is an elevational view illustrating an apparatus for forming an end portion of a pipe in accordance with the present invention.

FIG. 1 illustrates the whole construction of a pipe end portion forming apparatus in accordance with the present invention. In FIG. 1, a main body 2 of the pipe end portion forming apparatus is mounted horizontally on a supporting stand 3. A driving device M such as an electric motor is mounted at one end of the main body 2 while at the other end there is provided a pipe clamping device 4 for securely holding an end portion of a pipe P to be formed. When the pipe is to be formed, it is inserted into the clamping device 4.

Figure 2:
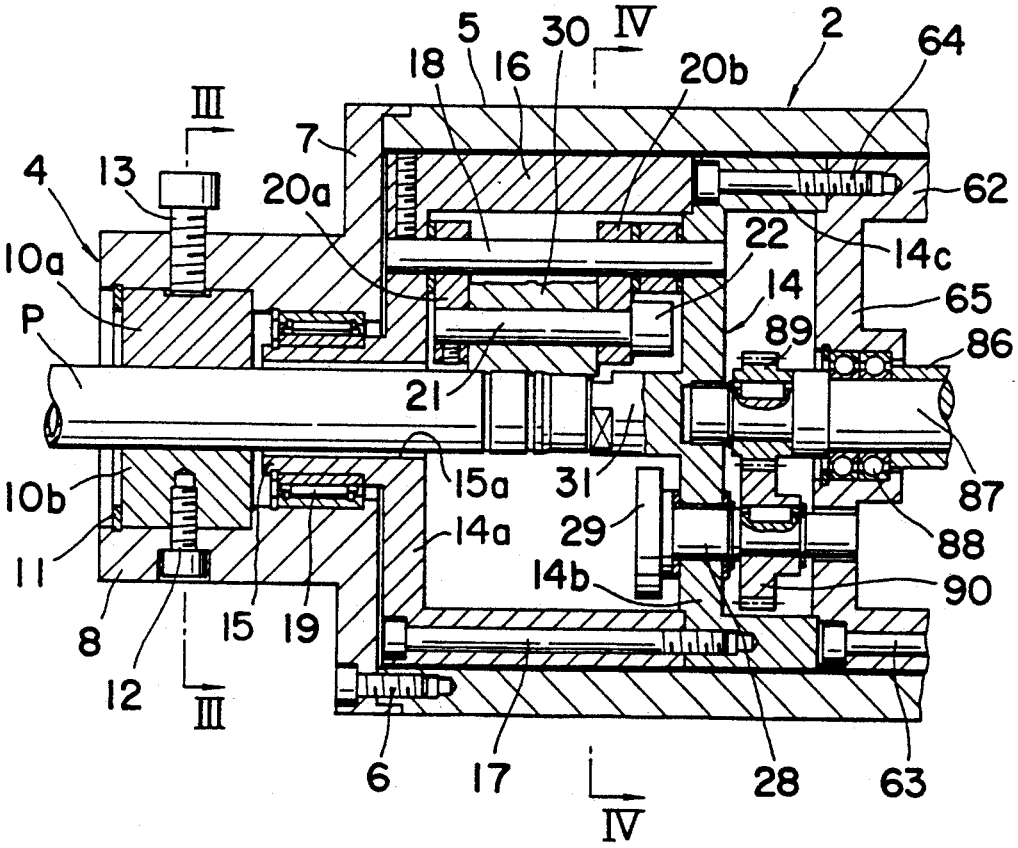
FIG. 2 is a vertical section, on an enlarged scale, illustrating the lefthand end portion of the apparatus shown in FIG. 1.
Figure 3:
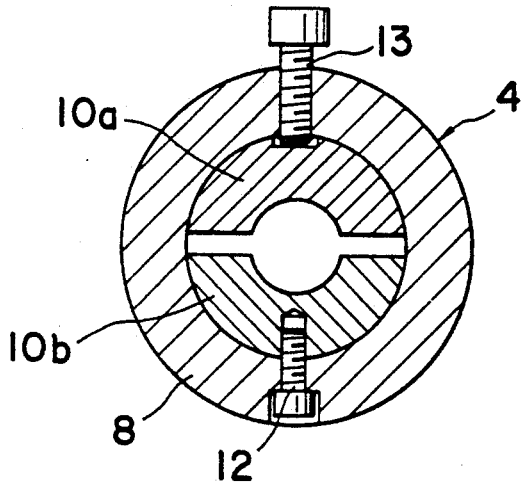
FIG. 3 is a sectional view taken along the line III—III of FIG. 2.

FIG. 2 shows in vertical section a lefthand side portion of the main body 2. The main body 2 has a cylindrical casing 5 on the left end as viewed in FIG. 2. The pipe clamping device 4 is secured to the casing 5 by means of bolts 6. The pipe clamping device 4 comprises a mounting plate 7, and a cylinder 8 formed integral with the mounting plate 7. Upper and lower chuck halves 10*a* and 10*b* are housed within the cylinder 8 in such a way that they are prevented from slipping out from the lefthand end of the cylinder 8.

As shown in a cross sectional view taken along the line III—III of FIG. 2, the chuck halves 10*a* and 10*b* are each in the form of a semicircular arc. The lower chuck half 10*b* is securely attached to the cylinder 8 with bolts 12 while the upper chuck half 10*a* is adapted to move downwardly when a locking bolt 13 threadably passed through the cylinder 8 is screwed downwardly. Therefore, when the end portion of the pipe P to be formed is inserted from the left to the right in FIG. 2 between the chuck halves 10*a* and 10*b* and then the bolt 13 is tightened, the pipe P to be formed is clamped immovably between the upper and lower chuck halves 10*a* and 10*b*.

As shown in FIG. 2, a rotary assembly 14 is disposed within the casing 5 adjacent to the pipe clamping device 4. The rotary assembly 14 has a pair of parallel rotary disks 14*a* and 14*b*. In this embodiment, the rotary disks 14*a* and 14*b* are fixedly secured to each other by means of bolts 17 which are passed through a cylindrical portion 16 made integral with one rotary disk 14*a*. A hollow stub shaft 15 integral with the rotary disk 14*a* is extended axially from the center thereof and is rotatably supported within the cylinder 8 through a bearing 19. The stub shaft 15 has a hole 15*a* through which the end portion of the pipe P is passed.

A plurality of pivot shafts 18 extend in parallel with the pipe P to be formed and are fixed at both ends thereof to the rotary disks 14*a* and 14*b*. As is clearly seen from FIG. 4, which is a sectional view taken along the line IV—IV in FIG. 2, the ends of the pivot shafts 18 are equiangularly secured to the disk plates 14*a* and 14*b*, respectively, and the number of the shafts 18 are three, for example. A swing assembly 20 is swingably mounted at its proximal end to each pivot shaft 18. The swing assembly 20 comprises a pair of swing arms 20*a* and 20*b* (FIG. 2) which are spaced apart axially from each other by a suitable distance. These swing arms 20*a* and 20*b* are radially inwardly extended from each pivot shaft 18 toward the outer peripheral surface of the pipe P to be formed and have a common mounting shaft 21 securely attached to the distal ends thereof, respectively. A cam follower 22 is securely attached on the end of the shaft 21 on the side of the rotary disk 14*b*.

Figure 4:
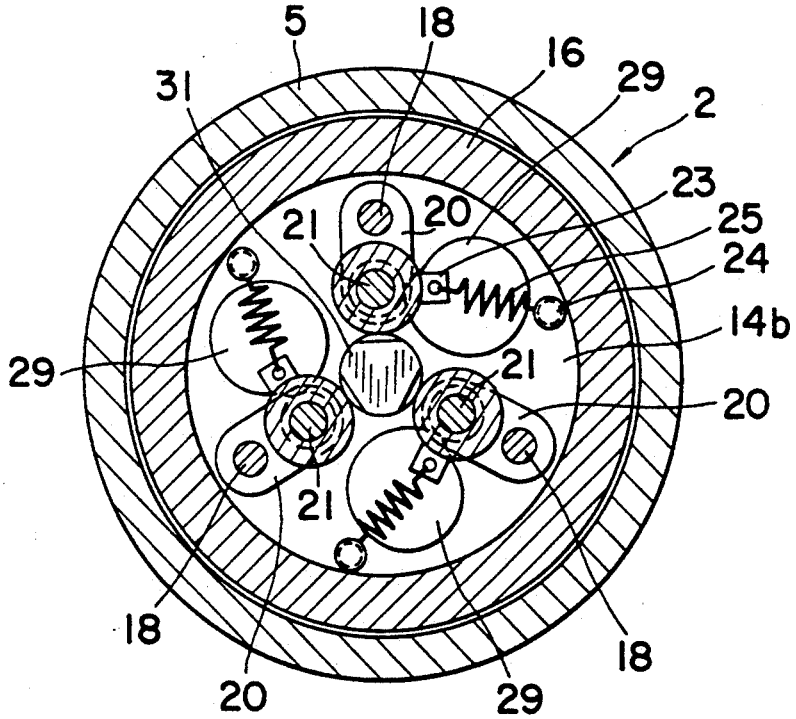
FIG. 4 is a sectional view taken along the line IV—IV of FIG. 2.
Figure 5:
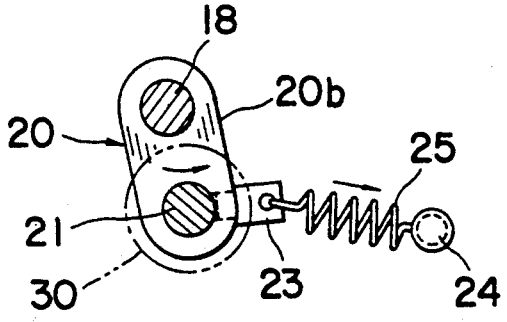
FIG. 5 is a view for explaining the relationship between a swing assembly and biasing means.

As shown in FIGS. 4 and 5, a tension spring 25 is loaded between a spring retaining bracket 23 on one side of the distal end of the swing arm 20*b* and a pin 24 fixed on the rotary disk 14*b*, so that the swing assembly 20 is biased in the counterclockwise direction by the tension spring 25. The tension spring 25 constitutes biasing means.

Figure 6:
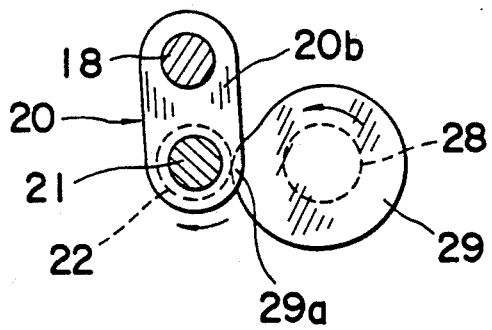
FIG. 6 is a view explanatory of the relationship between a rotary assembly and a cam.

As shown in FIG. 2, rotary cam shafts 28 are passed through and supported by the rotary disk 14*b* and cams 29 are securely fixed to the cam shafts 28, respectively. Each of the cams 29 is disposed adjacent to each corresponding swing assembly 20. As shown in FIG. 6, the cam 29 has a raised lobe portion 29*a* on the peripheral surface thereof. Each cam 29 coacts with each corresponding cam follower 22. When the lobe portion 29*a* engages the cam follower 22 as the cam shaft 28 is rotated, the swing assembly 20 is caused to rotate about the shaft 18 in the clockwise direction against the force of the tension spring 25 as viewed in FIG. 6.

Figure 7:
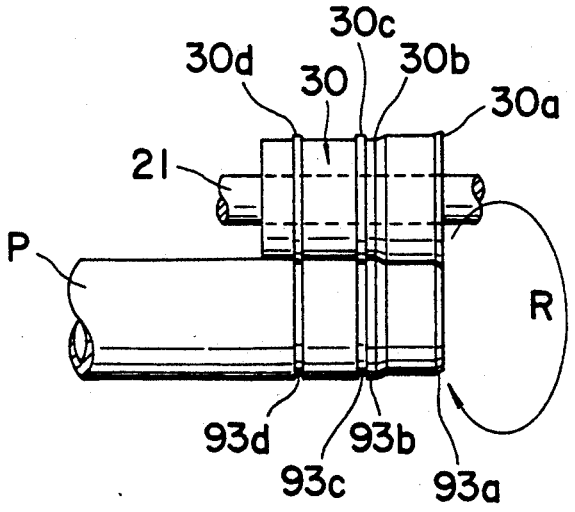
FIG. 7 is an elevation showing the relationship between a profile roll and a pipe to be formed.

As indicated in FIG. 2, a profile roll 30 is rotatably carried by the mounting shaft 21 at the distal end of each swing assembly 20 so that the roll 30 can be rotatable between the swing arms 20*a* and 20*b*. As shown in FIG. 7, the peripheral surface of the profile roll 30 is formed with a suitable profile. In this embodiment, the profile is shown to have a projection 30*a*, a recess 30*b* and projections 30*c* and 30*d*.

The profile roll 30 is spaced apart from the peripheral surface of the pipe P to be formed in the state of FIG. 5, while in the state as shown in FIG. 6 in which the cam lobe portion 29*a* acts on the cam follower 22, the profile roll 30 is pressed against the peripheral surface of the pipe P to be worked.

As shown in FIG. 2, a pipe abutment portion 31 projects toward the pipe P to be formed from the center of the rotary disk 14*b*. When the pipe P is inserted into the pipe clamping device 4, the end of the pipe P will abut against the abutment portion 31 to be axially placed in position.

When the rotary assembly 14 including the rotary disks 14*a* and 14*b* are caused to rotate by a rotation mechanism to be described hereinafter, the swing arms 20*a* and 20*b*, cam followers 22, cams 29 and profile rolls 30 which are all supported by the rotary assembly 14 will be caused to revolve around the pipe P to be formed. While revolving, the cams 29 will be rotated through the respective cam shafts 28 by the rotation mechanism and will act on the cam followers 22. The above-mentioned mode of operation will be described in more detail hereinafter.

The rotation mechanism which causes the rotation of the rotary assembly 14 and the cam shafts 28 concurrently will be described with reference to FIG. 8, which illustrates a central portion of FIG. 1 on an enlarged scale as well as a mechanism connected to the righthand side of the mechanism shown in FIG. 2.

Figure 8:
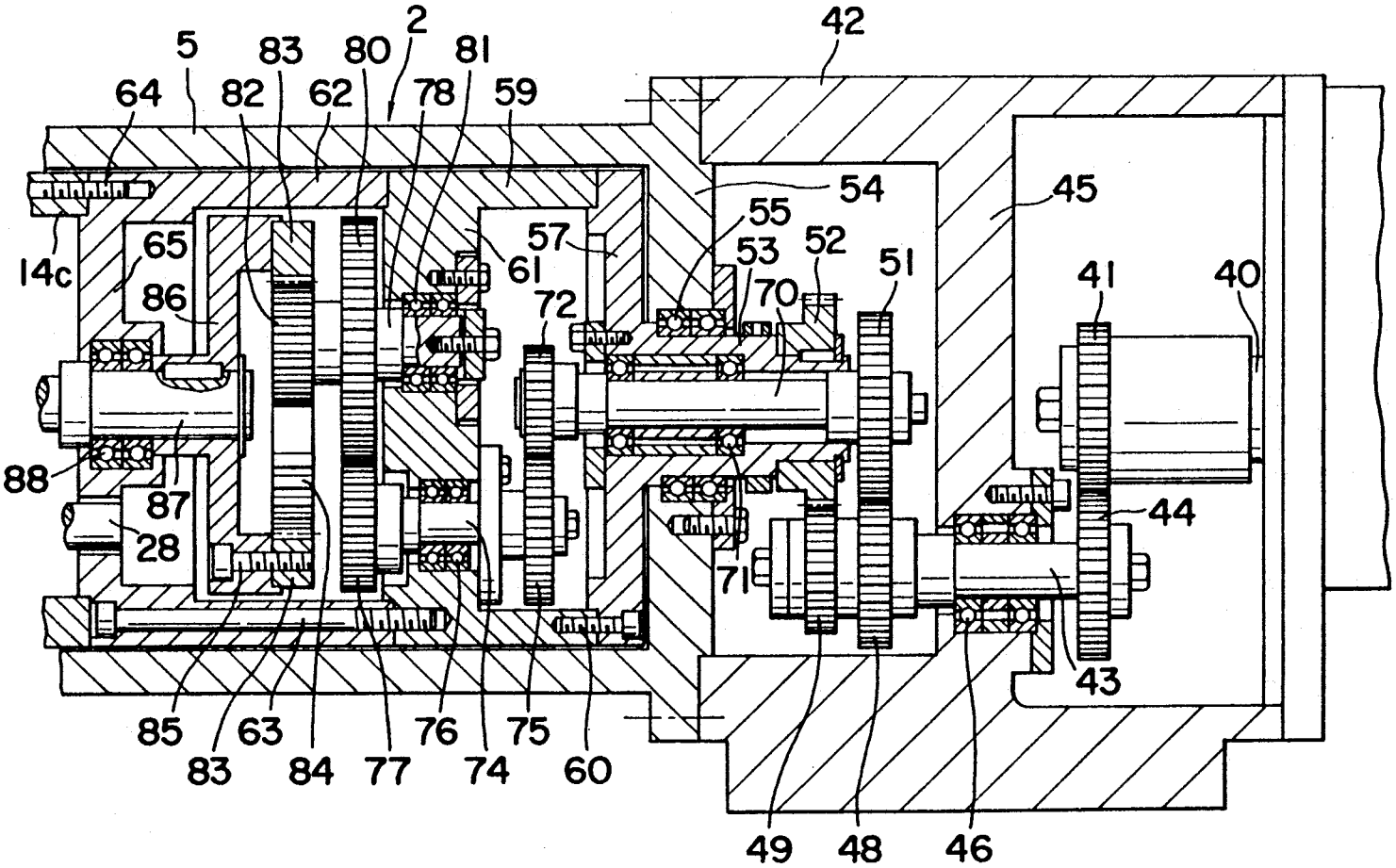
FIG. 8 is a sectional view illustrating an intermediate portion of the apparatus shown in FIG. 1.

In FIG. 8, the output shaft of the motor M (not shown in this figure) is shown at 40 on the righthand side of FIG. 8. The output shaft 40 has a gear 41 in mesh with a gear 44 at one end of a first intermediate shaft 43 which is rotatably supported through a bearing 46 by a partition wall 45 within a casing 42 that is securely joined to the casing 5. The intermediate shaft 43 carries two gears 48 and 49 at the other end thereof. The gear 48 is in mesh with a gear 51 while the other gear 49, a gear 52.

The gear 52 is securely mounted on a hollow shaft 53 which is rotatably supported through a bearing 55 by a partition wall 54 integral with the casing 5. The hollow shaft 53 has a circular flange 57 integral therewith which is securely attached to a first cylindrical member 59 by means of bolts 60. The flange 57 is made integral with a partition wall 61. Furthermore, the first cylindrical member 59 is securely attached to a second cylindrical member 62 with bolts 63, and the member 62 is securely attached to an annular flange 14*c* of the rotary assembly 14 with bolts 64 as also shown in FIG. 2. The second cylindrical member 62 has a partition wall 65 integral therewith.

When the motor M is energized to operate the above-described rotation mechanism, the rotary assembly 14 is caused to rotate through the output shaft 40 of the motor M, the gears 41 and 44, the first intermediate shaft 43, the gears 49 and 52, the hollow shaft 53, the first and second cylindrical members 59 and 62.

The gear 51 is securely carried by one end of a second intermediate shaft 70 which is rotatably supported through a bearing 71 within the hollow shaft 53. The other end of the second intermediate shaft 70 carries a gear 72 which is engaged with a gear 75 carried by one end of a third intermediate shaft 74. The shaft 74 is supported through a bearing 76 by the partition wall 61 and carries a gear 77 on the opposite side thereof. The gear 77 is in mesh with a gear 80 fixed to a support shaft 78, which is rotatably supported by the partition wall 61 via a bearing 81.

A further gear 82 is securely mounted on the support shaft 78 in coaxial relationship with the gear 80. The gear 82 is engaged with an internal ring gear 83 which is securely fixed to an annular member 86 with bolts 85. The annular member 86 is securely mounted on a fourth intermediate shaft 87 which is supported through a bearing 88 by the partition wall 65.

As shown in FIG. 2, the lefthand end of the intermediate shaft 87 is supported in a recess of the rotary disk **14*b* and a gear 89 is securely mounted on the intermediate shaft 87 at a position near the end thereof. The gear 89 is in mesh with three gears 90 securely carried by the three cam shafts 28**, respectively.

When the motor M with the above described rotation mechanism is energized, the three cams 29 are rotated in synchronism with each other through the output shaft 40, gear 41, first intermediate shaft 43, gears 48 and 51, second intermediate shaft 70, gears 72 and 75, third intermediate shaft 74, gears 77 and 80, support shaft 78, gear 82, internal ring gear, annular member 86, fourth intermediate gears 87, gear 89 and three cam shafts 28. The rotation of these cams 29 is carried out while revolving in response to the rotation of the rotary assembly 14.

As shown in FIG. 1, the motor M is controlled by a timer T. After a predetermined time interval set by the timer T, the motor M is automatically deenergized.

The mode of operation of the pipe end portion forming apparatus with the above stated construction will now be described.

At the site where a pipe is to be connected to a pipe coupling, a pipe P to be formed is inserted into the pipe end portion forming apparatus in the direction indicated by the arrow in FIG. 1 so that the leading end of the pipe P is brought into contact with the abutment portion 31 and the pipe is securely positioned in the axial direction. Thereafter, the locking bolt 13 is tightened so that the pipe P is securely clamped and held in position by the chuck halves **10*a* and 10*b***.

Figure 9:
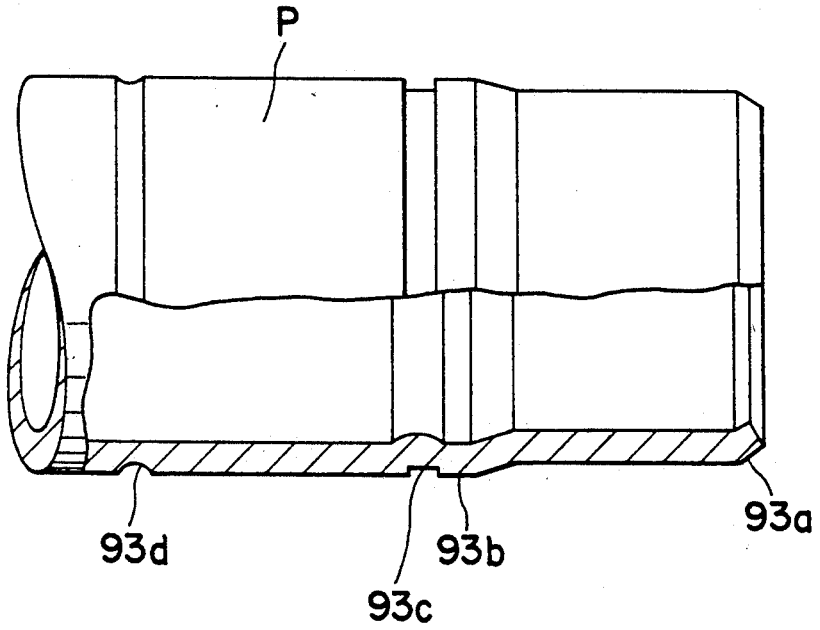
FIG. 9 is an elevation, on an enlarged scale, of a pipe formed.

Thereafter, the motor M is connected to the power source and is energized. Then, the rotary assembly 14 and all the cam shafts 28 are rotated so that all the cams 29 are also caused to rotate. As a result, the peripheral surface gradually increasing in diameter of each cam 29 starts to thrust the corresponding cam follower 22. Therefore, as best shown in FIG. 4, all the swing assemblies 20 start to rotate gradually about the respective shafts 18 against the force of the biasing springs 25 in the clockwise direction. Because of the rotation of the swing assemblies 20 described above, the profile rolls 30 are caused to gradually approach the peripheral surface of the pipe P to be formed and push them radially inwardly. While pushing the pipe, all the profile rolls 30 revolve around the pipe P because of the rotation of the rotary assemblies 14 so that profile rolls 30 are forcibly pressed against the peripheral surface of the pipe P while revolving in the direction indicated by the arrow R. Until the cam lobe portions **29*a* finally engage the cam followers 22, the cross section of the pipe P is caused to assume the section shown in FIG. 7 having the profile complementary to that of the profile rollers 30 by plastic deformation. More specifically, as shown FIGS. 7 and 9, a tapered surface 93*a*, an annular protrusion 93*b* and grooves 93*c* and 93*d* are formed in accordance with the projection 30*a*, recess 30*b* and projections 30*c* and 30*d* of the profile roll 30, respectively. It is to be noted that the profile rolls 30** may have any suitable profile pattern.

The motor M is deenergized after lapse of a time interval set by the time T. When the time has elapsed, the cam lobes **29*a* have moved off the cam followers 22 and the lowermost peripheral surface portion of each cam 29 is in contact with the corresponding cam follower 22. Therefore, the swing assemblies 20 have returned to their initial position indicated in FIG. 5 under the force of the bias springs 25 and the profile rolls 30 have moved away from the peripheral surface of the pipe P. When the locking bolt 13 is loosened, the formed pipe P can be withdrawn from the pipe clamping device 4**.

Figure 10:
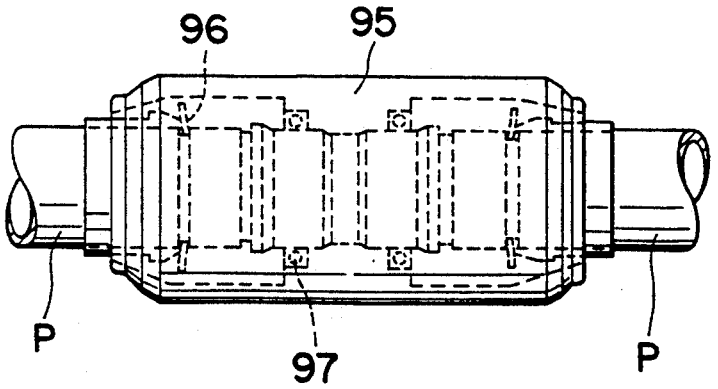
FIG. 10 is an elevation illustrating a coupling joining two pipes formed by the present invention.

The thus formed end portion of the pipe is inserted into a coupling main body 95 from the right and left sides as shown in FIG. 10. Because of the formation of the grooves, tapered surfaces and so on over the peripheral surface of the end portion of the pipe P, it can be inserted by one step into, and held tightly by, the coupling main body through elastic engaging members 96 and annular seal members 97.

According to the present invention, the profile rolls are caused to revolve around and pressed radially inwardly against a pipe to be formed which is securely clamped. Therefore the plastic profile formation over the peripheral surface of the pipe to be formed can be accomplished without the cumbersome work for rotating a pipe to be formed about its longitudinal axis. The side force imparting means, such as cams, gradually press and swing the rotary assembly in order to press the profile rolls against a pipe to be formed. As a result, as compared with the prior art of the type in which hydraulic cylinders are used for radially inward pressing from outside, the mechanism is compact in size or less bulky, light in weight and reliable in operation.

What is claimed is:

1. An apparatus for forming an end portion of a pipe comprising:

stationary pipe holding means for securely and stationarily holding an end portion of a pipe to be formed;

rotary means provided adjacent to said pipe holding means so as to be rotatable coaxially with the end portion of said pipe held by said pipe holding means;

drive means for rotating said rotary means;

a plurality of pivot shafts securely held by said rotary means so as to extend parallel with and be disposed around said pipe held by the pipe holding means;

a plurality of swing arm means having proximal ends pivoted to said pivot shafts, respectively, and having distal ends directed radially inward in opposing relationship with said end portion of said pipe to be formed;

a plurality of profile rolls carried by the distal ends of said swing arm means, respectively;

biasing means for imparting forces to said swing arm means so that said swing arm means will be caused to rotate about said pivot shafts in such directions that said profile rolls are moved away from said end portion of the pipe in a substantially cirucmferential direction of the pipe; and lateral force application means supported by said rotary means adjacent to a lateral side of each swing arm means for imparting a force to each swing arm means in a lateral direction across the swing arm means against the force of said biasing means in such a manner that the profile roll on each swing arm means will advance substantially circumferentially of said end portion of the pipe to act on the end portion radially inwardly of the same.

2. The apparatus according to claim 1, wherein said pipe holding means has therein chuck means for immovably clamping the end portion of the pipe.

3. The apparatus according to claim 1, wherein said rotary means includes mutually parallel rotary disks spaced apart in the axial direction of the end portion of the pipe, and that one of the rotary axis has an axial hole through which the end portion of the pipe is inserted into the space between the rotary disks, and the other of the rotary disks has an abutment portion for abutting engagement with the inserted end portion of the pipe.

4. The apparatus according to claim 3, wherein said pivot shafts are disposed in angularly spaced relation about the axis of rotation of the rotary means and are fixedly secured to the rotary disks at both ends thereof.

5. The apparatus according to claim 4, wherein each of said swing arm means comprises swing arms disposed between said rotary disks in an axially spaced relation, and each of said profile rolls is provided between the rotary disks.

6. The apparatus according to claim 5, wherein said profile roll is rotatably mounted on a mounting shaft fixed to distal ends of the swing arms so as to extend parallel to said pivot shafts.

7. The apparatus according to claim 6, wherein said mounting shaft has on one end thereof means to be acted upon by said lateral force application means.

8. The apparatus according to claim 7, wherein said lateral force application means is a rotary cam disposed laterally of the swing arms and said means to be acted upon is a cam follower.

9. The apparatus according to claim 8, wherein said rotary cam is rotatably supported by said other rotary disk.

10. The apparatus according to claim 9, wherein said rotary cam has a peripheral surface of gradually increasing radius with a projecting lobe.

11. The apparatus according to claim 1, wherein said biasing means are springs each having one end anchored to the rotary means and the other end anchored to the swing means.

12. The apparatus according to claim 1, wherein said drive means is operatively connected to said lateral force application means.

* * * * *